US010295209B2

(12) United States Patent
Yabunouchi et al.

(10) Patent No.: US 10,295,209 B2
(45) Date of Patent: May 21, 2019

(54) AIR-CONDITIONING SYSTEM AND CONTROLLER

(71) Applicant: PANASONIC INTELLECTUAL PROPERTY MANAGEMENT CO., LTD., Osaka (JP)

(72) Inventors: Nobuaki Yabunouchi, Kyoto (JP); Hayato Takahashi, Hyogo (JP); Naoki Muro, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 62 days.

(21) Appl. No.: 14/783,966

(22) PCT Filed: Apr. 8, 2014

(86) PCT No.: PCT/JP2014/002004
§ 371 (c)(1),
(2) Date: Oct. 12, 2015

(87) PCT Pub. No.: WO2014/167837
PCT Pub. Date: Oct. 16, 2014

(65) Prior Publication Data

US 2016/0069579 A1 Mar. 10, 2016

(30) Foreign Application Priority Data

Apr. 12, 2013 (JP) ..... 2013-083761

(51) Int. Cl.
*F24F 11/00* (2018.01)
*F24F 11/30* (2018.01)
(Continued)

(52) U.S. Cl.
CPC ..... *F24F 11/0001* (2013.01); *F24F 11/30* (2018.01); *F24F 11/62* (2018.01);
(Continued)

(58) Field of Classification Search
CPC ..... F24F 11/0001; F24F 11/0002; F24F 11/0012; F24F 11/0034; F24F 11/006;
(Continued)

(56) References Cited

U.S. PATENT DOCUMENTS 2,858,678 A * 11/1958 Rose ..... F24F 1/02 62/267
5,239,834 A * 8/1993 Travers ..... F25D 16/00 165/248
(Continued)

FOREIGN PATENT DOCUMENTS

EP 0 001 377 A1 4/1979
EP 0 856 708 A2 8/1998
(Continued)

OTHER PUBLICATIONS

International Search Report and Written Opinion issued in corresponding International Patent Application No. PCT/JP2014/002004, dated Jul. 1, 2014; 11 pages with English translation.
(Continued)

*Primary Examiner* — Christopher R Zerphey
*Assistant Examiner* — Hans R Weiland
(74) *Attorney, Agent, or Firm* — McDermott Will & Emery LLP

(57) ABSTRACT

The air-conditioning system includes: an opening/closing device opening and closing an openable portion in an opening of a building; an air-conditioning device performing air-conditioning inside the building by consuming energy for operation; a monitoring device monitoring environmental information regarding the inside and outside of the building; and a controller controlling the opening/closing device and the air-conditioning device based on the environmental information from the monitoring device, date and time information representing a current date and time,
(Continued)

building information representing a location condition of the building, and draft information determined by parameters including an opening area and an opening shape in the openable portion. The controller opens the openable portion and stops the air-conditioning device when the outside is more favorable in air environment than the inside, and closes the openable portion and starts the air-conditioning device when the inside is more favorable in air environment than the outside.

10 Claims, 3 Drawing Sheets

(51) Int. Cl.

| | |
|---|---|
| ***F24F 120/12*** | (2018.01) |
| ***F24F 110/12*** | (2018.01) |
| ***F24F 11/62*** | (2018.01) |
| *F24F 140/60* | (2018.01) |
| *F24F 110/10* | (2018.01) |
| *F24F 120/10* | (2018.01) |
| *F24F 140/40* | (2018.01) |
| *F24F 11/56* | (2018.01) |
| *F24F 11/46* | (2018.01) |

(52) U.S. Cl.
CPC ..... *F24F 11/46* (2018.01); *F24F 11/56* (2018.01); *F24F 2011/0002* (2013.01); *F24F 2110/10* (2018.01); *F24F 2110/12* (2018.01); *F24F 2120/10* (2018.01); *F24F 2120/12* (2018.01); *F24F 2140/40* (2018.01); *F24F 2140/60* (2018.01)

(58) Field of Classification Search
CPC ..... F24F 2011/0002; F24F 2011/0013; F24F 2011/0035; F24F 2011/003; F24F 2011/0047; F24F 2011/0056; F24F 2011/0068; F24F 2011/00756; F25D 16/00; F28F 11/0001; F28F 11/30; F28F 2120/10; F28F 2120/12; F28F 2140/40; F28F 2011/0002
USPC ..... 165/248, 250; 62/262
See application file for complete search history.

(56) References Cited

U.S. PATENT DOCUMENTS

| | | | | |
|---|---|---|---|---|
| 5,902,183 | A | 5/1999 | D'Souza | |
| 6,749,125 | B1 * | 6/2004 | Carson | F24F 7/08 165/248 |
| 2009/0013703 | A1 * | 1/2009 | Werner | F24F 11/0001 62/180 |
| 2010/0312397 | A1 | 12/2010 | George | |
| 2012/0065783 | A1 | 3/2012 | Fadell et al. | |

FOREIGN PATENT DOCUMENTS

| | | | |
|---|---|---|---|
| JP | 05-0001841 | A | 1/1993 |
| JP | 05-099485 | A | 4/1993 |
| JP | 11-211165 | A | 8/1999 |
| JP | 2001-304655 | A | 10/2001 |
| JP | 2002-250548 | A | 9/2002 |
| JP | 2006-097273 | A | 4/2006 |
| JP | 2006-170464 | A | 6/2006 |
| JP | 2010-276271 | A | 12/2010 |
| JP | 2012-017861 | A | 1/2012 |
| JP | 2012-241923 | A | 12/2012 |

OTHER PUBLICATIONS

Extended European Search Report issued in corresponding European Patent Application No. 14782912.1, dated Oct. 5, 2016.

* cited by examiner

AIR-CONDITIONING SYSTEM AND CONTROLLER

RELATED APPLICATIONS

This application is the U.S. National Phase under 35 U.S.C. § 371 of International Patent Application No. PCT/JP2014/002004, filed on Apr. 8, 2014, which in turn claims the benefit of Japanese Application No. 2013-083761, filed on Apr. 12, 2013, the disclosures of which Applications are incorporated by reference herein.

TECHNICAL FIELD

This invention generally relates to air-conditioning systems and controllers used therein, and specifically relates to an air-conditioning system configured to automatically open and close an openable portion such as a window and a door that is provided in an opening of a building and a controller used therein.

BACKGROUND ART

Heretofore, there has been proposed a system having a function of automatically opening and closing a window of a room (e.g., see JP 2006-170464A (hereinafter referred to as "Document 1"), for example).

The system disclosed in Document 1 includes a ventilation fan configured to ventilate a room, a window opening/closing means configured to open and close a window, and a monitoring means configured to determine an operating state of the ventilation fan via a network and cause the window opening/closing means to open and close the window. The monitoring means causes the window opening/closing means to open the window when the ventilation fan starts operation, and causes the window opening/closing means to close the window when the ventilation fan stops operation.

Therefore, according to the system disclosed in Document 1, when a user starts operation of the ventilation fan, the window is automatically opened and thus an opening for securing air flow is available. As a result, predetermined ventilation performance can be obtained even if the airtightness of the room is high. The user is free from inconvenience accompanying the opening/closing of the window, because the user does not need to go to the place where the window is located and open the window every time the ventilation fan is operated.

Also, the system disclosed in Document 1 includes a human detection sensor and is configured such that a window of a room in which a person is absent is preferentially opened. Therefore, the ventilation performance can be maintained without causing change in the temperature of a room in which a person is present. Furthermore, the system disclosed in Document 1 includes an outdoor temperature sensor configured to measure the outdoor temperature. The monitoring means reduces the opening amount of the window and lowers the operating capacity of the ventilation fan when the outdoor temperature is lower than a predetermined value, and as a result the room temperature is prevented from lowering.

However, in the system described in Document 1, the ventilation performance of the ventilation fan is improved as a result of the monitoring means causing the openable portion (window or door) to openable in conjunction with the ventilation fan, and an energy saving effect obtained by opening/closing the openable portion cannot particularly be expected.

SUMMARY OF INVENTION

The present invention has been made in view of the above-described problems, and an object of the present invention is to provide an air-conditioning system and a controller which are capable of achieving an energy saving effect by automatically opening and closing an openable portion of a building.

The air-conditioning system of the first aspect according to the present invention includes an opening/closing device, an air-conditioning device, a monitoring device, and a controller. The opening/closing device is configured to cause an openable portion provided in an opening of a building to switch between an open state of allowing movement of air between an inside and an outside of the building, and a closed state. The air-conditioning device is configured to perform air-conditioning inside the building by consuming energy for operation. The monitoring device is configured to monitor environmental information regarding the inside and the outside of the building. The controller is configured to control the opening/closing device and the air-conditioning device based on the environmental information obtained from the monitoring device, date and time information representing a current date and time, building information representing a location condition of the building, and draft information determined by parameters including an opening area and an opening shape in the openable portion. The controller is configured to, when an air environment outside the building is more favorable than an air environment inside the building, select an energy saving mode of setting the openable portion to the open state and stopping the air-conditioning device. Also, the controller is configured to, when the air environment inside the building is more favorable than the air environment outside the building, select an air-conditioning mode of setting the openable portion to the closed state and starting the air-conditioning device.

In the air-conditioning system of the second aspect according to the present invention, realized in combination with the first aspect, the controller includes a clock configured to indicate a current time and a storage device configured to store a time slot determined as a security time slot. The controller is configured to, while the current time is in the security time slot, select a security mode of setting the openable portion to the closed state, instead of the energy saving mode.

The air-conditioning system of the third aspect according to the present invention, realized in combination with the first or second aspect, further includes a first detector configured to determine whether a person is present inside the building. The controller is configured to, while determining that a person is absent inside the building based on a determination result of the first detector, select a security mode of setting the openable portion to the closed state, instead of the energy saving mode.

The air-conditioning system of the fourth aspect according to the present invention, realized in combination with any one of the first to third aspects, further includes a second detector configured to determine whether a person is present in a lookout region that is set in an area surrounding the building. The controller is configured to, while determining that a person is present in the lookout region based on a determination result of the second detector, select a security mode of setting the openable portion to the closed state, instead of the energy saving mode.

In the air-conditioning system of the fifth mode according to the present invention, realized in combination with any one of the first to fourth aspects, the air-conditioning device includes a function of adjusting temperature inside the building. The monitoring device is configured to monitor the environmental information including temperature.

In the air-conditioning system of the sixth aspect according to the present invention, realized in combination with any one of the first to fourth aspects, the controller is configured to, when selecting the energy saving mode, adjust an opening degree of the openable portion based on the environmental information.

The controller of the seventh aspect according to the present invention includes a first control unit, a second control unit, a first obtaining unit, and a processing unit. The first control unit is configured to control an opening/closing device configured to cause an openable portion provided in an opening of a building to switch between an open state of allowing movement of air between an inside and an outside of the building, and a closed state. The second control unit is configured to control an air-conditioning device configured to perform air-conditioning inside the building by consuming energy for operation. The first obtaining unit configured to obtain, from a monitoring device configured to monitor environmental information regarding the inside and the outside of the building, the environmental information. The processing unit is configured to determine control contents of the opening/closing device and the air-conditioning device based on the environmental information, date and time information representing a current date and time, building information representing a location condition of the building, and draft information determined by parameters including an opening area and an opening shape in the openable portion. The processing unit is configured to, when an air environment outside the building is more favorable than an air environment inside the building, select an energy saving mode of setting the openable portion to the open state and stopping the air-conditioning device. Also, the processing unit is configured to, when the air environment inside the building is more favorable than the air environment outside the building, select an air-conditioning mode of setting the openable portion to the closed state and starting the air-conditioning device.

DESCRIPTION OF EMBODIMENTS

Embodiment 1

The air-conditioning system of the present embodiment is a system to be installed in a building in order to automatically open and close one or more openable portions such as windows and doors provided in openings of the building. In the following description, the air-conditioning system is installed in a single dwelling. However, the building in which the air-conditioning system is installed is not limited to the single dwelling, and may be a multiple dwelling, a store, an office building, a factory, or the like.

Figure 1:
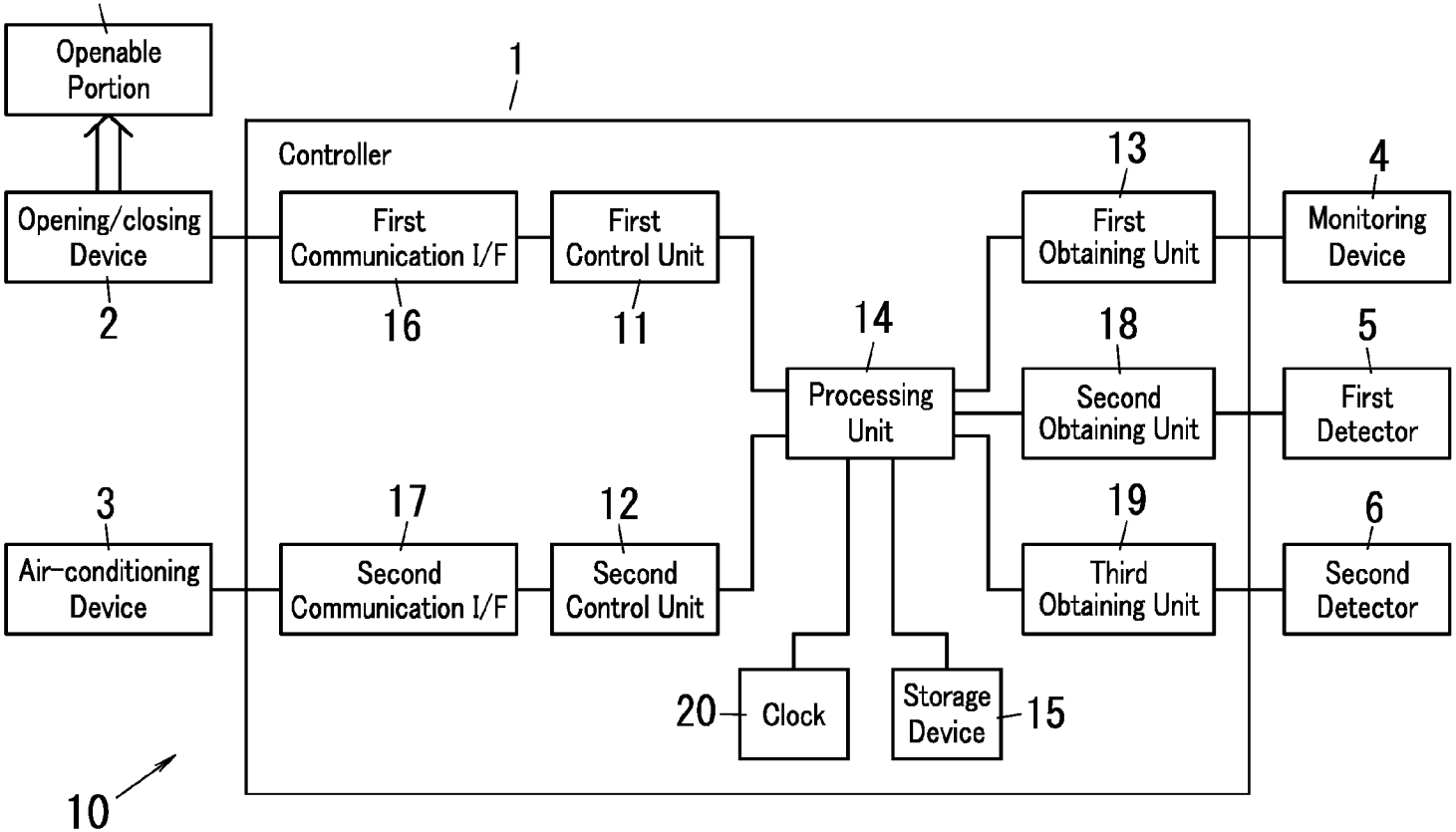
FIG. 1 is a schematic block diagram illustrating an air-conditioning system according to Embodiment 1.

The air-conditioning system 10 includes an opening/closing device 2, an air-conditioning device 3, a monitoring device 4, and a controller 1, as shown in FIG. 1. The opening/closing device 2 is configured to cause an openable portion 21 provided in an opening of a building to switch between an open state of allowing movement of air between an inside and an outside of the building and a closed state. The air-conditioning device 3 is configured to perform air-conditioning inside the building by consuming energy for operation. The monitoring device 4 is configured to monitor environmental information of the air inside and outside the building. The controller 1 is configured to control the opening/closing device 2 and the air-conditioning device 3 based on the environmental information obtained from the monitoring device 4, the date and time information representing the current date and time, the building information representing a location condition of the building, and the draft information determined by parameters including an opening area and an opening shape in the openable portion 21.

The controller 1 is configured to, when the air environment outside the building is more favorable than the air environment inside the building, select an energy saving mode of setting the openable portion 21 to the open state and stopping the air-conditioning device 3. Also, the controller 1 is configured to, when the air environment inside the building is more favorable than the air environment outside the building, select an air-conditioning mode of setting the openable portion 21 to the closed state and starting the air-conditioning device 3.

Hereinafter, configurations of the components of the air-conditioning system 10 according to the present embodiment will be described in more detail.

The openable portion 21 may be provided in an opening of a building (single dwelling) and be configured to switch between an open state of allowing movement of air between an inside and an outside of the building and a closed state of prohibiting (or restricting) the movement of air. That is, while the openable portion 21 is in the open state, it allows the air to move between the inside and the outside of the building through the opening. While the openable portion 21 is in the closed state, it prohibits (or restricts) the air from moving between the inside and the outside of the building through the opening.

The openable portion 21 is not limited to a window or a door, and may be a ventilation louver that can be opened and closed by changing the louver angle, a shutter provided at a ventilation opening, or the like, for example. What type of the openable portion 21 is to be used is determined according to the location or the purpose of the installation. For example, a window is used in a place required to let light in and ensure a field of vision, or a ventilation louver is used for a wall in a vicinity of a ceiling.

The opening/closing device 2 is configured to cause the openable portion 21 as described above to switch between an open state and a closed state. The opening/closing device 2 includes a motive power source (not shown) such as a motor, and is a device for automatically opening/closing the openable portion 21 by motive power generated by the motive power source. The opening/closing device 2 is provided for each openable portion 21.

The opening/closing device 2 includes a communication function with the controller 1, and is configured to switch the state of the openable portion 21 between the open state and the closed state according to a control signal transmitted from the controller 1. Note that, when the openable portion 21 is a lockable window or door, the opening/closing device 2 is configured to automatically open and close the openable portion 21 and additionally lock and unlock the openable portion 21.

Although one opening/closing device 2 and one openable portion 21 are illustrated in FIG. 1, in actuality, a set of one opening/closing device 2 and one openable portions 21 is provided in at least each room, and as for the entire building (single dwelling), there are multiple sets.

The air-conditioning device 3 is configured to adjust the temperature, humidity, cleanliness, airflow, and the like of the air inside the building, and is a device for maintaining the inside of the building in a comfortable state. The air-conditioning device 3 is a cooling and heating apparatus such as an air conditioner or a floor heater, an air purifier, a dehumidifier, a humidifier, a circulator, or the like. Note that the air-conditioning device 3 as referred to here includes only a device that consumes energy such as electric power or gas in operation, and does not include a device that does not consume any energy in operation.

Hereinafter, an air conditioner that is provided in each room of a building (single dwelling) and is a cooling and heating apparatus including a function of adjusting the temperature (atmospheric temperature) inside the building by consuming electric energy (electric power) will be described as an example of the air-conditioning device 3. The air-conditioning device 3 includes a function of communicating with the controller 1, and is configured to switch between at least an operation state and a rest state according to a control signal transmitted from the controller 1. Furthermore, the air-conditioning device 3 includes a function of determining a desired temperature according to a control signal from the controller 1.

The monitoring device 4 is configured to monitor the environmental information including temperature (atmospheric temperature). Here, the monitoring device 4 is configured to monitor information that includes a plurality of items such as a wind direction (airflow direction), a wind velocity (airflow velocity), and air contamination (odor, powder dust, chemical substances, bacteria, and the like) in addition to basic items of the air quality such as temperature and humidity, as the environmental information relating to the air environment.

Therefore, the monitoring device 4 is configured by compositely combining various types of sensors, such as a temperature sensor, a humidity sensor, a wind direction and velocity sensor, an odor sensor, and an airborne particle sensor, for detecting information related to the air environment. Since the monitoring device 4 monitors the environmental information regarding the inside and the outside of the building, such sensors described above are provided both inside and outside the building.

Also, the monitoring device 4 is configured to calculate the time period during which the openable portion 21 is to be kept in the open state not only using the environmental parameter measurement results measured by the above sensors but also using the building information and the draft information along with them. Here, the indices, namely the building information and the draft information, are information which is prepared to allow the monitoring device 4 to estimate the environmental information regarding the outside of the building, and is unique to the room.

The building information is information for specifying the installation environment (in other words, location conditions) of the room to be monitored by the monitoring device 4, and the installation environment includes pieces of information such as an address, an elevation, a building in the surrounding area, the height of a nearby obstacle, and the distance to the obstacle. By using a conversion table (detail is not disclosed) for converting numerical values representing these pieces of information to an approximate numerical value of wind velocity, an approximate wind velocity outside the building can be estimated even without a general wind velocity sensor. Also, because the value of wind velocity to be estimated by the above conversion table changes according to the season or the date and time, information on the season and the date and time (hereinafter referred to as date and time information) is also used to determine the value of wind velocity.

Also, the draft information is information which is used for calculating draft amount and includes a resistance coefficient and a wind pressure coefficient that are determined by parameters including the opening area and the opening shape in the openable portion 21, for example. The controller 1 approximately predicts the amount of wind that will flow into the building through the openable portion 21 with reference to an estimated value of wind velocity based on output from the wind velocity sensor and the building information and a predicted value of wind velocity based on the draft information.

Also, the monitoring device 4 may include a function for connecting to the Internet. In this case, the monitoring device 4 can predict the temperature, humidity, wind direction, and wind velocity outside the building based on the weather information of the area in the vicinity of the building provided from a weather forecast server, for example.

Here, the above building information and draft information may be stored in an external server having high confidentiality (not shown) and be read out by the controller 1 via a network as necessary. Also, the above conversion table may be stored in an external server having high confidentiality and be read out by the controller 1 via a network.

Furthermore, the above resistance coefficient and wind pressure coefficient may also be stored in an external server having high confidentiality, and be read out from the external server via a network and used when the controller 1 carries out an operation. This processing is executed in steps S6 and S7 in FIG. 3 to be described later.

Here, with respect to at least the building information of the above building information and draft information, an address, a telephone number of a person signing a rental agreement contractor, a password, and the like are inputted using an unshown input interface (e.g., a liquid crystal panel, for example) for specifying the room of interest. The controller 1 specifies the building information inputted via the input interface as the above building information of the residence contractor. Accordingly, the above building information can be protected as personal information, and furthermore, a changing residence or the like can be dealt with easily.

Note that in the case where the room of interest is in a multiple dwelling, the room number used in the apartment building is also included in the above address. Also, the telephone number of the residence contractor may be a fixed-line phone number or a mobile phone number. Furthermore, it is possible to cause the processing unit 14 to recognize the building information not via the above input interface but via a radio apparatus, for example.

Furthermore, the environmental information to be monitored by the monitoring device 4 may include a factor, other than those described in the above example, which affects the comfort of the resident and can be adjusted by the air-conditioning device 3.

The monitoring device 4 is connected to the controller 1 and outputs the environmental information to the controller 1 regularly or in response to the request from the controller 1. The monitoring device 4 outputs, to the controller 1, a set of the environmental information regarding the inside of the building and the environmental information regarding the outside of the building each of which includes a plurality of items.

The controller 1 includes a first control unit 11, a second control unit 12, a first obtaining unit 13, a processing unit 14, a storage device 15, a first communication interface (hereinafter, "interface" is represented as "I/F") 16, and a second communication I/F 17, as shown in FIG. 1. Also, in the example in FIG. 1, the controller 1 further includes a second obtaining unit 18, a third obtaining unit 19, and a clock 20.

In the present embodiment, the controller 1 includes a computer as a main component, and realizes functions of the units by executing a program stored in the storage device 15. Note that the controller 1 reads out the above program from a recording medium or downloads it from a server (not shown) via the Internet, and installs the program.

The first control unit 11 includes a function of controlling the opening/closing device 2. Here, the first communication I/F 16 includes a function of bidirectionally communicating with the opening/closing device 2, and the first control unit 11 is configured to control the opening/closing device 2 by transmitting a control signal to the opening/closing device 2 via the first communication I/F 16. Furthermore, the first control unit 11 receives a monitoring signal indicating the open/closed state (e.g., the open state and the closed state) of the openable portion 21 from the opening/closing device 2 via the first communication I/F 16, thereby monitoring the open/closed state of the openable portion 21. The communication between the controller (first communication I/F 16) 1 and the opening/closing device 2 may be wireless communication or wired communication.

The second control unit 12 includes a function of controlling the air-conditioning device 3. Here, the second communication I/F 17 includes a function of bidirectionally communicating with the air-conditioning device 3, and the second control unit 12 is configured to control the air-conditioning device 3 by transmitting a control signal to the air-conditioning device 3 via the second communication I/F 17. Furthermore, the second control unit 12 receives a monitoring signal indicating the operating state (e.g., the operation state and the rest state) of the air-conditioning device 3 from the air-conditioning device 3 via the second communication I/F 17, thereby monitoring the operating state of the air-conditioning device 3. The communication between the controller (second communication I/F 17) 1 and the air-conditioning device 3 may be wireless communication or wired communication.

The first obtaining unit 13 includes a function of obtaining environmental information from the monitoring device 4. Here, the first obtaining unit 13 is connected to the monitoring device 4, and obtains the environmental information regarding both the inside and outside of the building that is outputted regularly from the monitoring device 4. Alternatively, the first obtaining unit 13 sends a request to the monitoring device 4 in order to obtain the environmental information regarding both the inside and outside of the building that is outputted from the monitoring device 4 in response to the request.

The processing unit 14 is configured to determine the control contents of the opening/closing device 2 and the air-conditioning device 3 based on the environmental information obtained by the first obtaining unit 13, the above date and time information, building information, and draft information. The first control unit 11, the second control unit 12, and the first obtaining unit 13 are connected to the processing unit 14. The processing unit 14 is configured to compare the environmental information regarding the outside of the building and the environmental information regarding the inside of the building, select the operation mode according to the comparison result, and determine the control contents of the opening/closing device 2 and the air-conditioning device 3.

Note that the correspondence relationship between the operation mode (control contents of the opening/closing device 2 and the air-conditioning device 3) and the comparison result of the environmental information regarding the inside and the outside of the building is pre-stored in the storage device 15 as a control table, and the processing unit 14 selects the operation mode with reference to the control table.

The processing unit 14 is configured to, when the air environment outside the building is more favorable than the air environment inside the building, select the energy saving mode of setting the openable portion 21 to the open state and stopping the air-conditioning device 3. For example, in summer, when the temperature outside the building decreases due to sunset or the like and the outside of the building is cooler (lower in temperature) than the inside of the building, a resident may feel that the outside of the building is more comfortable than the inside of the building. Or, in winter, when the temperature outside the building increases due to solar radiation or the like and the outside of the building is warmer (higher in temperature) than the inside of the building, the resident may feel that the outside of the building is more comfortable than the inside of the building.

In these cases, the processing unit 14 determines that the air environment outside the building is more favorable than the air environment inside the building based on the comparison result between the environmental information (temperature) regarding the outside of the building and the environmental information (temperature) regarding the inside of the building, and selects the energy saving mode. In other words, when the comfort inside the building is improved by taking the air outside the building in the inside of the building, the processing unit 14 selects the energy saving mode.

On the other hand, processing unit 14 is configured to, when the air environment inside the building is more favorable than the air environment outside the building, select the air-conditioning mode of setting the openable portion 21 to the closed state and starting the air-conditioning device 3. For example, in summer, when the inside of the building is cooler (lower in temperature) than the outside of the building, a resident may feel that the inside of the building is more comfortable than the outside of the building. Or, in winter, when the inside of the building is warmer (higher in temperature) than the outside of the building, the resident may feel that the inside of the building is more comfortable than the outside of the building.

In these cases, the processing unit 14 determines that the air environment inside the building is more favorable than the air environment outside the building based on the comparison result between the environmental information (temperature) regarding the outside of the building and the environmental information (temperature) regarding the inside of the building, and selects the air-conditioning mode. In other words, when taking the air outside the building into the inside of the building causes a decrease in comfort inside the building, the processing unit 14 selects the air-conditioning mode.

The processing unit 14 determines the control contents of the opening/closing device 2 and the air-conditioning device 3 in accordance with the selected operation mode (energy saving mode or air-conditioning mode), and executes control of the opening/closing device 2 and the air-conditioning device 3 with the first control unit 11 and the second control unit 12.

Figure 2B:
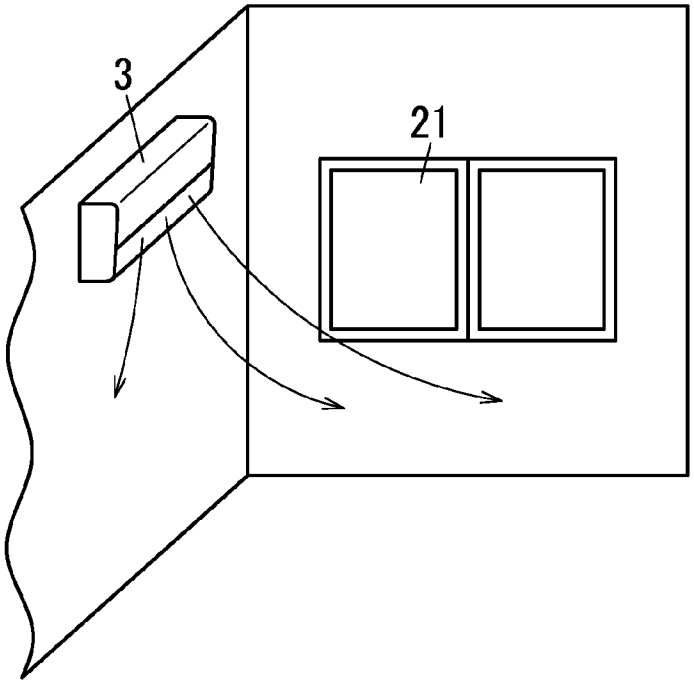
FIGS. 2A and 2B are diagrams illustrating operations of the air-conditioning system according to Embodiment 1.
Figure 2A:
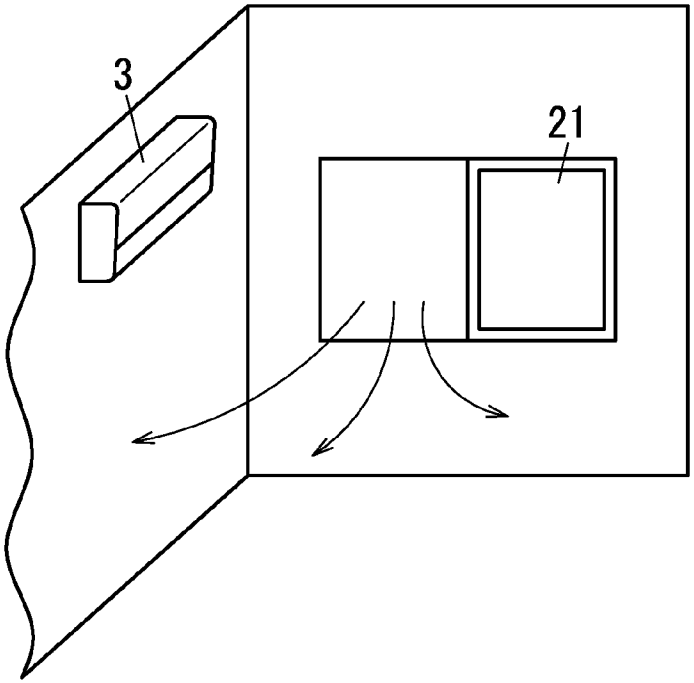

That is to say, when the processing unit 14 selects the energy saving mode, the processing unit 14 causes the first control unit 11 to control the opening/closing device 2 such that the openable portion 21 is set to the open state, and causes the second control unit 12 to control the air-conditioning device 3 to stop. Accordingly, the controller 1 automatically opens a window serving as the openable portion 21 and automatically stops an air conditioner serving as the air-conditioning device 3, as illustrated in FIG. 2A, and can improve the comfort inside the building by taking the air outside the building into the inside of the building.

On the other hand, when the processing unit 14 selects the air-conditioning mode, the processing unit 14 causes the first control unit 11 to control the opening/closing device 2 such that the openable portion 21 is set to the closed state, and causes the second control unit 12 to control the air-conditioning device 3 to operate. Accordingly, the controller 1 automatically closes the window serving as the openable portion 21 and automatically starts the air conditioner serving as the air-conditioning device 3, as illustrated in FIG. 2B, and can improve the comfort inside the building by the air-conditioning device 3. The controller 1 may be configured to indicate a desired temperature by a control signal.

In this case, the controller 1 is desirably configured to determine the desired temperature based on the environmental information obtained by the first obtaining unit 13. As described above, in the air-conditioning system 10 of the present embodiment, the controller 1 controls the opening/closing device 2 and the air-conditioning device 3 in a coordinated manner so as to obtain a highest possible energy saving effect.

Also, the thermal comfort of a person in a room is affected by factors such as clothing insulation and a metabolic rate of the person in the room in addition to the room temperature, the average radiation temperature, the relative humidity, and the average wind velocity. Accordingly, the monitoring device 4 may be configured to monitor the environmental information including the clothing insulation and the metabolic rate of the resident (person in the room) inside the building. In this case, the controller 1 is desirably configured to obtain an index such as a PMV (Predicted Mean Vote) index based on the environmental information, and determine which of the air environment outside the building and the air environment inside the building is more favorable (that is, more comfortable) using the index.

Note that the air-conditioning system 10 of the present embodiment is configured such that the processing unit 14 selects the energy saving mode so as to obtain the highest possible energy saving effect when the air environment outside the building and the air environment inside the building are the same. Accordingly, the controller 1 selects the energy saving mode when the air environment outside the building is equivalent to or more favorable than the air environment inside the building, in other words, when the comfort outside the building is equal to or more than the comfort inside the building. Note that when the comfort inside the building is prioritized, the air-conditioning system 10 may be configured such that the processing unit 14 selects the air-conditioning mode when the air environment outside the building and the air environment inside the building are the same.

Also, in the case where the opening/closing device 2 and the openable portion 21 are provided in each of the rooms and the air-conditioning device 3 is also provided in each of the rooms, the controller 1 is desirably configured to pair the opening/closing device 2 and the air-conditioning device 3 in the same room and perform control for each pair (that is, for each room). In this case, the controller 1 also obtains the environmental information from the monitoring device 4 regarding each of the rooms, and controls the opening/closing device 2 and the air-conditioning device 3 of each of the rooms based on the environmental information regarding the corresponding room. Note that the configuration is not limited to this example, and the controller 1 may be configured to collectively control the opening/closing devices 2 and the air-conditioning devices 3 in the whole building.

Additionally, the air-conditioning system 10 of the present embodiment is configured to obtain sufficient security by the controller 1 selecting the later described security mode instead of the above energy saving mode in the case where a predetermined condition is satisfied. In the present embodiment, the controller 1 uses three conditions, namely the time slot, the presence or absence of a person inside the building, and the presence or absence of a person in an area surrounding the building, as the condition for selecting the security mode.

Specifically, the controller 1 includes a clock 20 configured to indicate the current time and a storage device 15 configured to store a time slot determined as a security time slot, and is configured to, while the current time is in the security time slot, select the security mode of setting the openable portion 21 to the closed state, instead of the energy saving mode. That is, the controller 1 is configured to, when the current time indicated by the clock 20 is in the time slot stored in the storage device 15 in advance as the security time slot, select the security mode by the processing unit 14 irrespective of the air environment outside the building being more favorable than the air environment inside the building.

The processing unit 14, when selecting the security mode, causes the first control unit 11 to control the opening/closing device 2 such that the openable portion 21 is set to the closed state. The controller 1 does not necessarily control the air-conditioning device 3 when the security mode is selected, and may cause the air-conditioning device 3 to continue to be in the immediately previous operating state (operation or stoppage). Alternatively, the controller 1 may be configured to cause the second control unit 12 to control the air-conditioning device 3 such that the air-conditioning device 3 is stopped or the air-conditioning device 3 is started when the security mode is selected.

Here, when the resident controls the controller 1 to operate in a setting mode, the resident can arbitrarily set the security time slot using an input device (not shown) of the controller 1. For example, in accordance with the lifestyle pattern of the resident (or another resident), a daily sleeping period or an absent period can be set as the security time slot. Accordingly, in such a security time slot, the security mode can be selected instead of the energy saving mode.

According to this configuration, in the security time slot, if the air environment outside the building is more favorable than the air environment inside the building, the openable portion 21 is forcibly set to the closed state and sufficient security can be ensured.

Also, the air-conditioning system 10 further includes a first detector 5 configured to determine whether a person is present in the building, as shown in FIG. 1. The first detector 5 is constituted by one or more known human body detection sensors, and here includes pyroelectric infrared sensors arranged in various places in the building. Note that the first detector 5 is not limited to being constituted by the one or more human body detection sensor, and may include a device configured to determine whether a person is present according to the operation state of a switch that is operated by the resident when leaving home, or a device configured to determine whether a person is present by performing image processing on an image inside the building that is captured by a camera, for example.

In the controller 1, the second obtaining unit 18 has a function of obtaining a determination result from the first detector 5. Here, the second obtaining unit 18 is connected to the first detector 5, and is configured to obtain the determination result outputted from the first detector 5 every time the determination result changes. The controller 1 is configured to, while determining that a person is not present in the building based on the determination result of the first detector 5, select the security mode of setting the openable portion 21 to the closed state instead of the energy saving mode. That is, the controller 1 is configured to select the security mode with the processing unit 14 when the resident is away from home, that is, when a person is not present in the building, irrespective of the air environment outside of the building being more favorable than the air environment inside the building.

According to this configuration, when the resident is away from home, the openable portion 21 is mandatorily set to the closed state, even when the air environment outside the building is more favorable than the air environment inside the building, and as a result sufficient security can be ensured.

Also, the air-conditioning system 10 further includes a second detector 6 configured to determine whether a person is present in a lookout region that is set in an area surrounding the building, as shown in FIG. 1. The lookout region may be an appropriate region in the area surrounding the building, but is desirably a region in the vicinity of the openable portion 21 such as a window or a door. The second detector 6 is constituted by one or more known human body detection sensors, similarly to the first detector 5, and here includes one or more pyroelectric infrared sensors arranged such that the lookout region is the detection range. Note that the second detector 6 is not limited to being constituted by the one or more human body detection sensors, and may include a device that determines whether a person is present by performing image processing on an image inside the lookout region that has been captured by a camera, for example.

In the controller 1, the third obtaining unit 19 has a function of obtaining a determination result from the second detector 6. Here, the third obtaining unit 19 is connected to the second detector 6, and is configured to obtain the determination result that is outputted from the second detector 6 every time the determination result changes. The controller 1 is configured to, while determining that a person is present in the lookout region based on the determination result of the second detector 6, select the security mode of setting the openable portion 21 to the closed state instead of the energy saving mode. That is, the controller 1 is configured to select the security mode with the processing unit 14 when a person is present in the lookout region in the area surrounding the building even when the air environment outside the building is more favorable than the air environment inside the building.

According to this configuration, in a situation in which a suspicious person is present in the lookout region, the openable portion 21 is forcibly set to the closed state, even when the air environment outside the building is more favorable than the air environment inside the building, and as a result sufficient security can be ensured.

Note that the first detector 5 and the second detector 6 are not limited to detecting only a human body, and may be configured to additionally detect animals such as dogs and cats.

In the present embodiment, as described above, the controller 1 is configured to use three conditions, namely, the time slot, the presence or absence of a person inside the building, and the presence or absence of a person in the area surrounding the building, and select the security mode when at least any one of the three conditions is satisfied.

Note that the controller 1 need not use all the three conditions described above as the condition for selecting the security mode, and may use one or two of the three conditions. In this case, unnecessary configurations in the air-conditioning system 10 can be omitted appropriately. That is, in the air-conditioning system 10, when the presence or absence of a person inside the building is not used as the condition, the first detector 5 and the second obtaining unit 18 can be omitted. When the presence or absence of a person in the area surrounding the building is not used as the condition, the second detector 6 and the third obtaining unit 19 can be omitted.

Also, in the case where only energy saving is the object of the air-conditioning system 10, the above configuration for selecting the security mode itself can be omitted from the air-conditioning system 10.

Figure 3:
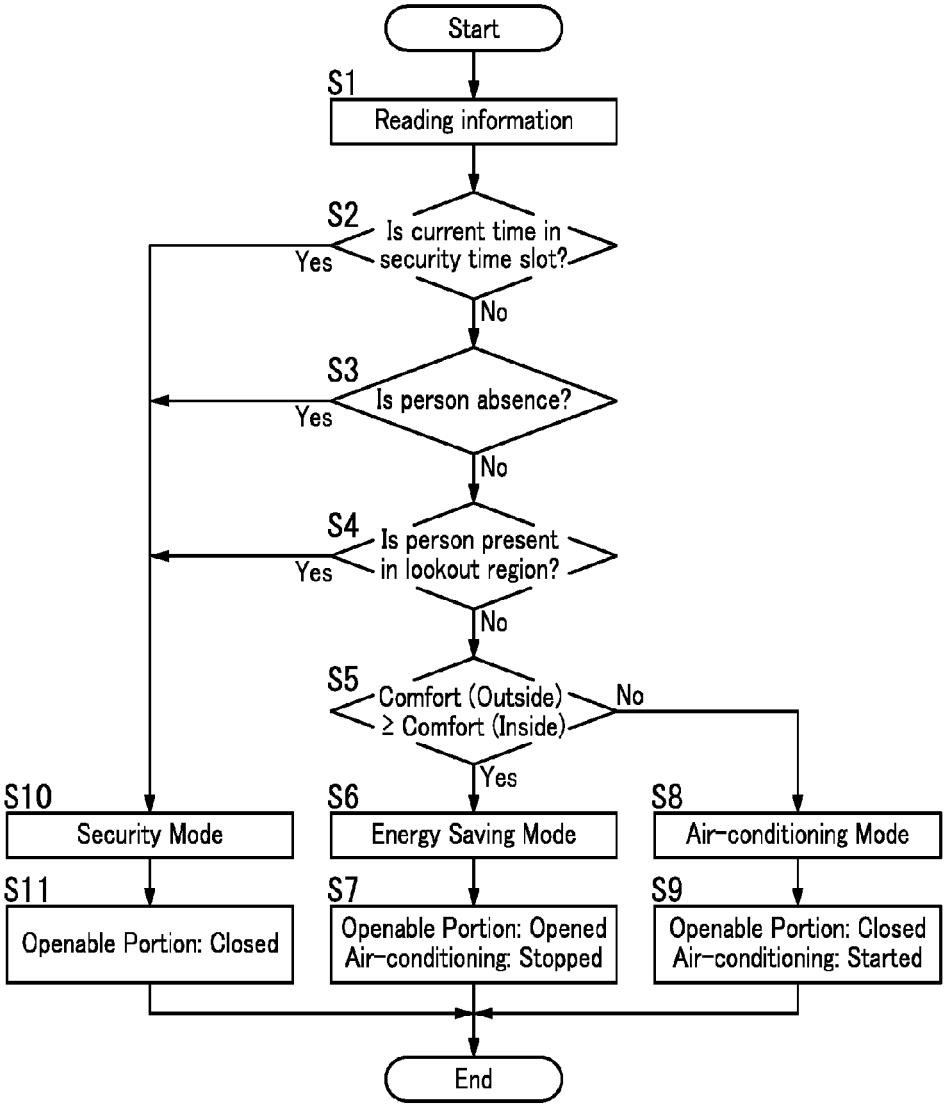
FIG. 3 is a diagram illustrating operations of a controller used in the air-conditioning system according to Embodiment 1.

Next, operations of the controller 1 of the air-conditioning system 10 of the present embodiment will be described with reference to FIG. 3.

First, in information reading processing, the controller 1 reads environmental information from the monitoring device 4, and reads information regarding determination results from the first detector 5 and the second detector 6 (S1). Thereafter, the controller 1 determines whether or not the current time is in the security time slot (S2). If the current time is not in the security time slot (S2: No), the controller 1 determines whether or not the resident is away from home (person is absent in the building) (S3). If the resident is not away from home (S3: No), the controller 1 determines whether or not a person is present in the lookout region (S4).

If there is no person in the lookout region (S4: No), the controller 1 compares the air environment outside the building and the air environment inside the building based on the environmental information, and determines whether or not the comfort outside the building is greater than or equal to the comfort inside the building (S5). Here, if the comfort outside the building is greater than or equal to the comfort inside the building (S5: Yes), the controller 1 selects the energy saving mode (S6), controls the opening/closing device 2 such that the openable portion 21 is set to the open state, and controls the air-conditioning device 3 to stop (S7).

In the present embodiment, the above building information and draft information are determined in the processing of steps S6 and S7, and the determined building information and draft information are used for the opening/closing control on the openable portion 21 by the opening/closing device 2.

On the other hand, if the comfort outside the building is less than the comfort inside the building (S5: No), the controller 1 selects the air-conditioning mode (S8), controls the opening/closing device 2 such that the openable portion 21 is set to the closed state, and controls the air-conditioning device 3 to operate (S9).

Also, if the current time is in the security time slot (S2: Yes), the resident is away from home (S3: Yes), or a person is present in the lookout region (S4: Yes), the controller 1 selects the security mode (S10) and controls the opening/closing device 2 such that the openable portion 21 is set to the closed state (S11).

The controller 1 repeats the processing from S1 to S11 described above.

The air-conditioning system 10 of the present embodiment described above includes the controller 1 configured to control the opening/closing device 2 and the air-conditioning device 3 based on the environmental information regarding the inside and the outside of the building that is obtained from the monitoring device 4, the above date and time information, building information, and draft information. The controller 1 is configured to, when the air environment outside the building is more favorable than the air environment inside the building, select the energy saving mode of setting the openable portion 21 to the open state and stopping the air-conditioning device 3. Also, the controller 1 is configured to, when the air environment inside the building is more favorable than the air environment outside the building, select the air-conditioning mode of setting the openable portion 21 to the closed state and starting the air-conditioning device 3.

That is to say, in the air-conditioning system 10 of the present embodiment, the controller 1 controls the opening/closing device 2 and the air-conditioning device 3 in a coordinated manner so as to obtain the highest possible energy saving effect. In short, when the comfort inside the building can be improved by taking the air outside the building into the inside of the building, the controller 1 causes the openable portion 21 to have the largest possible opening so as to improve the comfort inside the building without relying on the air-conditioning device 3.

According to the air-conditioning system 10, energy consumption of the air-conditioning device 3 can be suppressed, and additionally air-conditioning utilizing natural energy effectively, such as natural ventilation and a draft by opening the openable portion 21 can be performed. Therefore, an energy saving effect by automatically opening and closing the openable portion 21 of the building can be expected. As a result, the air-conditioning system 10 can realize the improvement of both the comfort inside the building and the energy saving effect.

Furthermore, in the present embodiment, the air-conditioning device 3 includes a function of adjusting the temperature inside the building, and the monitoring device 4 is configured to monitor the environmental information including the temperature. Therefore, the controller 1 can adjust the temperature inside the building to a comfortable temperature by controlling the opening/closing device 2 and the air-conditioning device 3 in a coordinated manner. According to the air-conditioning system 10, it is possible to avoid a situation in which the temperature inside the building becomes excessively high or low as a result of giving an excessive priority to energy saving and this burdens bodies of the residents.

Also, the air-conditioning system 10 of the present embodiment configured such that the controller 1 selects the security mode instead of the energy saving mode when the predetermined condition is satisfied, thereby ensuring sufficient security. That is, the controller 1 controls the opening/closing device 2 such that the openable portion 21 is closed in the security mode. Therefore, a suspicious person can be prevented from intruding into the building through the openable portion 21 which is opened, and security can be enhanced.

In the embodiment described above, the air conditioner including a function of adjusting the temperature (atmospheric temperature) inside the building is illustrated as an example of the air-conditioning device 3, but the air-conditioning device 3 is not limited to the example, and may be a device that consumes energy to operate and performs air-conditioning inside the building. For example, in the case where the air-conditioning device 3 is an air purifier, the controller 1 compares the environmental information (air contamination) regarding the outside of the building and the environmental information (air contamination) regarding the inside of the building and determines that the air environment having higher air cleanliness (having less air contamination) is favorable.

Also, the controller 1 may be configured to select an operation mode of setting the openable portion 21 to the closed state similarly to the security mode instead of the energy saving mode for a purpose other than enhancing security. For example, if the air-conditioning system 10 is used in combination with a rainfall sensor (not shown), the controller 1 is enabled to perform processing in which, when the environment outside the building degrades rapidly due to sudden rainfall or the like, an operation mode of setting the openable portion 21 to the closed state is selected instead of the energy saving mode based on the output of the rainfall sensor. Accordingly, the air-conditioning system 10 can prevent rain or the like from blowing in through the openable portion 21 which is opened.

Embodiment 2

The air-conditioning system 10 of the present embodiment differs from the air-conditioning system 10 of Embodiment 1 in that the controller 1 is configured to, when selecting the energy saving mode, adjust an opening degree of the openable portion 21 based on the environmental information. Hereinafter, components common to the present embodiment and Embodiment 1 are designated by common reference signs in order to avoid redundant description.

In the present embodiment, the processing unit 14 is configured to, when selecting the energy saving mode based on the environmental information obtained by the first obtaining unit 13, determine the control contents of the opening/closing device 2 and the air-conditioning device 3 including the opening degree of the openable portion 21. The opening degree of the openable portion 21 here is an opening area in terms of appearance thereof, and is represented by, for example, a slide (movement) amount of a window from a closed state in the case of an openable portion 21 constituted by a double sliding window, or an angle of each louver board in the case of an openable portion 21 constituted by a ventilation louver that can be opened and closed by changing the angle of each louver board.

For example, the processing unit 14 adjusts the ventilation amount (draft amount) appropriately by decreasing the opening degree of the openable portion 21 when the wind velocity outside the building is high, and increasing the opening degree of the openable portion 21 large when the wind velocity outside the building is low. Also, calculation for determining the opening degree of the openable portion 21 performed by the processing unit 14 may reflects a relationship between the orientation of the openable portion 21 and the direction of the wind outside the building. In the case where the wind direction and the wind velocity are used in this way, the processing unit 14 may estimate the draft condition inside the building based on the statistical information using address information of the building and date and time information, and determine the opening degree of the openable portion 21 based on the estimated result.

Furthermore, the controller 1 may be configured to, when the energy saving mode is selected and when the wind velocity outside the building is low or there is no wind, control a ventilation fan (not shown) to start in addition to the control on the opening/closing device 2 and the air-conditioning device 3.

Accordingly, when the air environment outside the building is more favorable than the air environment inside the building, the processing unit 14 selects the energy saving mode, causes the first control unit 11 to control the opening/closing device 2 such that the openable portion 21 is opened at an obtained opening degree, and causes the second control unit 12 to control the air-conditioning device 3 to stop. The first control unit 11 indicates the opening degree of the openable portion 21 with the control signal.

According to the air-conditioning system 10 of the present embodiment described above, when the controller 1 selects the energy saving mode, the opening degree of the openable portion 21 is adjusted based on the environmental information, and therefore the ventilation amount (draft amount) when performing natural ventilation or causing draft can be adjusted appropriately by opening the openable portion 21. Hence, the air-conditioning system 10 can further improve comfort inside the building.

Note that, in the case of the openable portion 21, such as a ventilation louver, that can be opened and closed by changing the angle of one or more louvers, the direction of an airflow in the building is changed according to the angle of the one or more louvers. Therefore, the processing unit 14 can also adjust the direction of the airflow with the opening degree of the openable portion 21.

Also, in the present embodiment, the controller 1 may have a cooperation mode of setting the openable portion 21 to the open state and starting the air-conditioning device 3, in addition to the operation modes (the energy saving mode, the air-conditioning mode, and the security mode) described above. In the cooperation mode, the controller 1 determines the opening degree of the openable portion 21 and the desired temperature of the air-conditioning device 3 based on the environmental information, for example, and as a result the energy saving effect can also be expected and yet the comfort inside the building is improved.

Note that, the air-conditioning system 10 can be constituted by appropriately combining the aforementioned components derived from not only the same embodiment but also the different embodiments. Also, the above embodiments are only aspects of the present invention, and various modifications can be made according to the design or the like, as long as the technical problems described in the present invention can be solved.

The invention claimed is:

1. An air-conditioning system comprising:

an opening/closing device configured to cause an openable portion provided in an opening formed in a part of a building to switch between an open state of allowing movement of air between an inside and an outside of the building, and a closed state;

an air-conditioning device, separate from the opening/closing device, configured to perform air-conditioning inside the building by consuming energy for operation;

a monitoring device configured to monitor environmental information regarding the inside and the outside of the building; and a controller configured to control the opening/closing device and the air-conditioning device based on the environmental information obtained from the monitoring device, date and time information representing a current date and time, building information representing a location condition of the building, or draft information for calculating a draft amount of ventilation passing through the opening of the building determined by parameters including an opening area and an opening shape in the openable portion, the controller being configured to, when a first condition is met, select an energy saving mode of setting the openable portion to the open state and stopping the air-conditioning device, the controller being configured to, when a second condition is met which is different than the first condition, select an air-conditioning mode of setting the openable portion to the closed state and starting the air-conditioning device, and the controller further having a cooperation mode of setting the openable portion to the open state and starting the air-conditioning device.

2. The air-conditioning system according to claim 1, wherein the controller includes a clock configured to indicate a current time and a storage device configured to store a time slot determined as a security time slot, and is configured to, while the current time is in the security time slot, select a security mode of setting the openable portion to the closed state, instead of the energy saving mode.

3. The air-conditioning system according to claim 1, further comprising a second detector configured to determine whether a person is present in a lookout region that is set in an area surrounding the building, the controller being configured to, while determining that a person is present in the lookout region based on a determination result of the second detector, select a security mode of setting the openable portion to the closed state, instead of the energy saving mode.

4. The air-conditioning system according to claim 1, wherein:

the air-conditioning device includes a function of adjusting temperature inside the building; and the monitoring device is configured to monitor the environmental information including temperature.

5. The air-conditioning system according to claim 1, wherein the controller is configured to, when selecting the energy saving mode, adjust an opening degree of the openable portion based on the environmental information.

6. The air-conditioning system according to claim 1, further comprising a first detector configured to determine whether a person is present inside the building, the controller being configured to, in response to determining that a person is absent inside the building based on a determination result of the first detector, select a security mode of setting the openable portion to the closed state, instead of the energy saving mode.

7. The air-conditioning system according to claim 6, wherein the controller is configured to continue selecting the security mode until the first detector detects a person inside the building.

8. A controller comprising:

a first control unit configured to control an opening/closing device configured to cause an openable portion provided in an opening formed in a part of a building to switch between an open state of allowing movement of air between an inside and an outside of the building, and a closed state;

a second control unit configured to control an air-conditioning device, which is separate from the opening/closing device, configured to perform air-conditioning inside the building by consuming energy for operation;

a first obtaining unit configured to obtain, from a monitoring device configured to monitor environmental information regarding the inside and the outside of the building, the environmental information; and a processing unit configured to instruct the first control unit and the second control unit to control the opening/closing device and the air-conditioning device based on the environmental information, date and time information representing a current date and time, building information representing a location condition of the building, or draft information for calculating a draft amount of ventilation passing through the opening of the building, the processing unit being configured to, when a first condition is met, select an energy saving mode of setting the openable portion to the open state and stopping the air-conditioning device, and the processing unit being configured to, when a second condition is met which is different than the first condition, select an air-conditioning mode of setting the openable portion to the closed state and starting the air-conditioning device, and the processing unit further having a cooperation mode of setting the openable portion to the open state and starting the air-conditioning device.

9. The controller according to claim 8, wherein the processing unit is configured to, in response to determining that a person is absent inside the building based on a determination result of a first detector configured to determine whether a person is present inside the building, select a security mode of setting the openable portion to the closed state, instead of the energy saving mode.

10. The controller according to claim 9, wherein the processing unit is configured to continue selecting the security mode until the first detector detects a person inside the building.

* * * * *